United States Patent [19]

Spears

[11] Patent Number: 4,697,369

[45] Date of Patent: Oct. 6, 1987

[54] NIGHT LOADER FOR GUNS

[76] Inventor: Ronald K. Spears, 3519 Gallia St., New Boston, Ohio 45662

[21] Appl. No.: 905,965

[22] Filed: Sep. 11, 1986

[51] Int. Cl.[4] ..... F41C 27/00; F42B 39/04

[52] U.S. Cl. ..... 42/89

[58] Field of Search ..... 42/89

[56] References Cited

U.S. PATENT DOCUMENTS 3,722,125 3/1973 Switzer ..... 42/89

4,202,124 5/1980 Switzer ..... 42/89

4,313,275 2/1982 Switzer ..... 42/89

*Primary Examiner*—Charles T. Jordan

*Attorney, Agent, or Firm*—Banner, Birch, McKie & Beckett

[57] ABSTRACT

The present invention relates to a cartridge speed loader for facilitating the loading of a gun under adverse lighting conditions. The speed loader includes a light source, preferably a light emitting diode, disposed on the bottom face of the speed loader cartridge housing to illuminate a cylinder of a gun into which cartridges are to be inserted.

10 Claims, 4 Drawing Figures

NIGHT LOADER FOR GUNS

TECHNICAL FIELD

The present invention relates to a speed loader for a gun and, in particular, to a speed loader that facilitates the loading of a gun in adverse lighting conditions.

BACKGROUND OF THE INVENTION

Speed loaders for revolvers and the like are well known in the art, as can be seen in U.S. Pat. Nos. 4,313,275, 4,202,124 and 3,722,125. The cartridges to be loaded are dropped one at a time into cylindrical bores in the housing of the speed loader. A locking mechanism is engaged to maintain the cartridges within the housing of the speed loader. The speed loader may then be carried on the person until needed. When a new round of cartridges is to be loaded n the gun, the user must align the cartridges within the speed loader with the cylinder of the gun and release the locking mechanism to insert the cartridges into the gun.

The disadvantage with this type of speed loader is that it is difficult to properly align the cartridges of the gun under adverse lighting conditions. Valuable time may be lost when hunting or during competition while fumbling with the loader in an attempt to align it properly in the dark, resulting in missed shots.

The night loader of the present invention overcomes the above disadvantage. The night loader includes a light source located on the bottom face of the cartridge housing and an energizing circuit for selectively activating and deactivating the light source. When switched on, the light source will illuminate the cylinder of the gun, thus facilitating easy alignment of the cartridges with the cylinder of the gun, even under adverse lighting conditions.

SUMMARY OF THE INVENTION

The present invention comprises a speed loader with a light source to facilitate loading a gun in extreme darkness. In a preferred embodiment the speed loader includes a cylindrical cartridge housing with a plurality of cartridge bores opening onto the bottom face of the housing. In the center of the bottom face there is a light source, preferably a light emitting diode. A switch is included in an energizing circuit, allowing the light source to be selectively turned on and off. A lock mechanism is provided within the cartridge housing for selectively releasing or securing the cartridge within the cartridge housing.

In operation, the cartridges are dropped into the bores in the cartridge housing and the lock mechanism is actuated so as to maintain the cartridges within the cartridge housing. In adverse lighting conditions, the user would set the switch to the on position, activating the light source which aids the user in aligning the cylinder of a gun. The lock assembly is then set to release the cartridges and the gun is loaded.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter in which there is illustrated and described an embodiment of this invention.

DETAILED DESCRIPTION OF THE DRAWINGS

Figure 1:
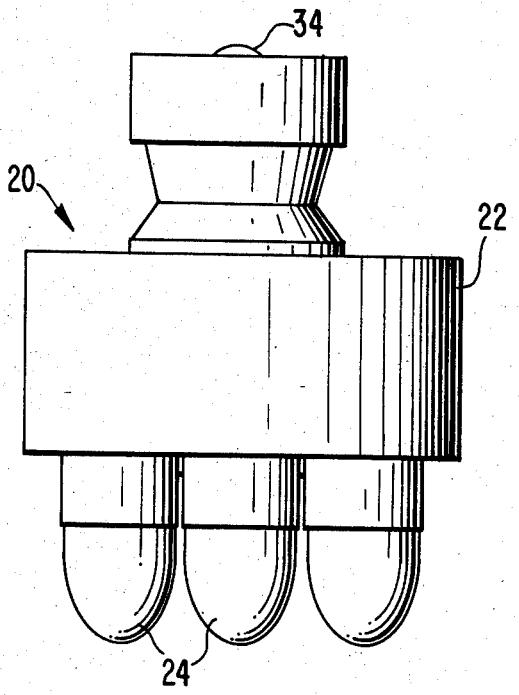
FIG. 1 is an external view of a night loader containing cartridges in accordance with the proposed invention.

A night loader according to the proposed invention is illustrated in FIG. 1 and generally designated as 20. Night loader 20 comprises a cylindrical cartridge housing 22 holding a plurality of cartridges 24 to be loaded into the cylinder of a revolver or the like. Within the cartridge housing 22 are a plurality of cartridge bores 30 which open onto the bottom face 32 of the cartridge housing. Then bores are located radially equidistant from the center of the bottom face. A light source 26, such as a light emitting diode, is located within cartridge housing 22 with the emitter disposed on the surface at the center of bottom face 32.

Figure 2:
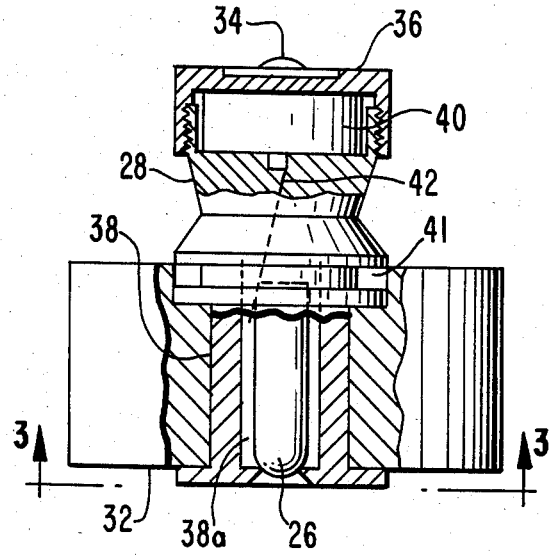
FIG. 2 is a cutaway view of a night loader exposing the internal structure.
Figure 3:
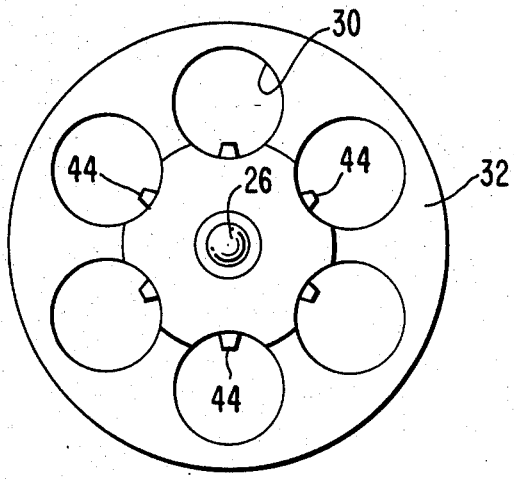
FIG. 3 is a bottom view of a night loader as shown in FIG. 2 and viewed along line 3.

An illumination and lock assembly 28, as shown in FIG. 2, including a conventional lock mechanism 41, is located within and extending above cartridge housing 22. Illumination and lock assembly 28 includes a manual light switch 34 extending outwardly of top face 36 of assembly 28 for selectively switching light source 26 on and off. Light source 26 is located within a central cylinder **38*a* in the lower portion of illumination and lock assembly 28 with the emitter extending to the surface of bottom face 32. The outer surface of cylinder 38*a* is in threaded engagement with outer cylinder 38 which together form the lower portion of illumination and lock assembly 28. Lock mechanism 41 includes locking teeth 44 extending radially outward to hold the cartridges in place when the lock assembly is actuated, as is shown in FIG. 3**.

Figure 4:
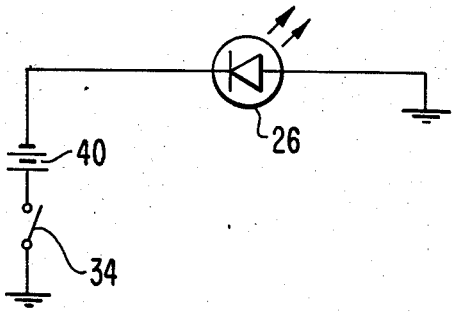
FIG. 4 is a schematic view of an energizing circuit of a preferred embodiment.

In a preferred embodiment shown in FIGS. 2 and 4, the energizing circuit within illumination and lock assembly 28 includes a power supply 40, preferably comprising at least one battery located within the upper portion of illumination and lock assembly 28. The battery 40 is connected in series to the light source 26 in the forward bias mode. The light source 26 has a grounded anode connected to a wire contact 42 which is selectively engageable to ground the positive terminal of battery 40 to complete the circuit. The light source 26 has a cathode connected to the negative terminal of the battery. Wire contact 42 is connected to manual switch 34 to allow the user to selectively energize or deenergize light source 26.

In operation, a cartridge is dropped into each cartridge bore and the lock mechanism 41 is actuated by rotating outer cylinder 38 so that teeth 44 secure the cartridges in place. The speed loader may then be stored on the person until needed. When using the speed loader to load the revolver under adverse lighting conditions, the switch 34 is actuated causing wire contact 42 to engage and complete the energizing circuit and energize light source 26. While the light is on, the user may easily align the cartridges within the speed loader with the cylinders of the gun, despite the adverse lighting conditions. Once the protruding ends of the cartridges are aligned and inserted into the cartridge bores of the revolver, the outer cylinder 38 is rotated back to its initial position, releasing the cartridges into the revolver, thereby completing the loading operation.

Numerous characteristics and advantages of the invention have been set forth in the foregoing description, together with details of the structure and function of the invention, and the novel features thereof are pointed out in the appended claims. The disclosure, however, is illustrative only and changes may be made in detail, especially in matters of shape, size and arrangement of parts, within the principle of the invention, to the full extent indicated by the broad general meaning of the terms in which the appended claims are expressed.

I claim:

1. A cartridge speed loader for loading a gun in extreme darkness comprising:

a cylindrical cartridge housing holding a plurality of cartridges to be loaded into a cylinder of a gun, said cartridge housing having a plurality of cartridge bores to hold said plurality of cartridges; and a combination illumination and lock assembly including a light source for illuminating a cylinder of a gun into which cartridges are to be inserted and a lock means for selectively releasing or securing cartridges within said cartridge housing.

2. A cartridge speed loader for loading a gun in extreme darkness according to claim 1 further comprising an energizing circuit within said illumination and lock assembly to selectively energize or deenergize said light source.

3. A cartridge speed loader for loading a gun in extreme darkness according to claim 2 wherein said energizing circuit includes a manual switch, a metal contact spring and at least one battery, said battery connected in series to said light source in the forward bias mode.

4. A cartridge speed loader for loading a gun in extreme darkness according to claim 3 wherein said light source is a light emitting diode having a grounded anode connected to said metal contact spring, said metal contact spring selectively engageable upon actuation of said manual switch to ground the positive terminal of said battery; and said light emitting diode having a cathode connected to the negative terminal of said battery.

5. A cartridge speed loader for loading a gun in extreme darkness according to claim 1 wherein said light source is a light emitting diode.

6. A cartridge speed loader for facilitating the loading of a gun in adverse lighting conditions comprising:

a cylindrical cartridge housing having a top and bottom face and holding a plurality of cartridges to be loaded into a cylinder of a gun, said cartridge housing having a plurality of cartridge bores located radially equidistant from the center of said housing and said bores opening onto the bottom face of said housing;

lock assembly means for selectively releasing or securing said plurality of cartridges within said cartridge housing;

illuminating means for illuminating a cylinder of a gun into which cartridges are to be inserted, said illuminating means fixed within said cartridge housing and having a light source; and an energizing circuit electrically connected to said illuminating means for selectively energizing or deenergizing said light source.

7. A cartridge speed loader for facilitating the loading of a gun in adverse lighting conditions according to claim 6 wherein said energizing circuit comprises a manual switch, a metal contact spring and a power supply.

8. A cartridge speed loader for facilitating the loading of a gun in adverse lighting conditions according to claim 7 wherein said power supply comprises at least one battery connected in series to said light source in the forward bias mode.

9. A cartridge speed loader for facilitating the loading of a gun in adverse lighting conditions according to claim 8 wherein said light source is a light emitting diode having a grounded anode connected to said metal contact spring, said metal contact spring selectively engageable to ground the positive terminal of said battery upon actuation of said manual switch, and said light emitting diode having a cathode connected to the negative terminal of the battery.

10. A cartridge speed loader for facilitating the loading of a gun in adverse lighting conditions according to claim 6 wherein said light source is a light emitting diode.

* * * * *